United States Patent [19]

Roberts

[11] 4,116,398

[45] Sep. 26, 1978

[54] AUTOMATIC RIBBON WINDING MACHINE

[75] Inventor: Bruce D. Roberts, Dayton, Ohio

[73] Assignee: Central States Tooling Service, Inc., Dayton, Ohio

[21] Appl. No.: 785,335

[22] Filed: Apr. 7, 1977

[51] Int. Cl.[2] ..... B65H 19/26; B65H 19/28; B65H 25/32

[52] U.S. Cl. ..... 242/56 R; 242/57; 242/74

[58] Field of Search ..... 242/56 R, 74, 195, 57, 242/56.8

[56] References Cited

U.S. PATENT DOCUMENTS

| | | | |
|---|---|---|---|
| 2,931,482 | 4/1960 | Bishop | 242/74 X |
| 3,477,657 | 11/1969 | Norbisrath | 242/56 R |
| 3,501,760 | 3/1970 | Menary | 242/57 X |
| 3,586,258 | 6/1971 | Horlezeder | 242/56 R X |
| 3,782,664 | 1/1974 | Alberto | 242/56 R |
| 3,880,373 | 4/1975 | Cook | 242/56 R |

*Primary Examiner*—Harvey C. Hornsby
*Assistant Examiner*—John M. Jillions
*Attorney, Agent, or Firm*—Biebel, French & Nauman

[57] ABSTRACT

A winder for such ribbons as typewriter ribbons, automatically advances the ribbon, attaches it to an empty spool, winds the proper length onto the spool, and then severs the ribbon. The ribbon is advanced and threaded by a movable boat having pins which grip the ribbon and pull it to the spool after a hole has been punched in the ribbon for hooking the ribbon onto the hub of the spool. The ribbon moves through a splice detector gap which terminates winding when a splice is detected to prevent winding a reel having a splice therein.

11 Claims, 10 Drawing Figures

AUTOMATIC RIBBON WINDING MACHINE

BACKGROUND OF THE INVENTION

This invention relates to ribbon winders, and more particularly to a machine for automatically winding spools of typewriter ribbon.

Prior art ribbon winders, tape winders, and so on, usually require considerable manual assistance during operation. For example, U.S. Pat. No. 3,967,789 shows a tape winding system requiring manual threading, starting, and termination of the winding operation. The ribbons must be firmly attached to the spool center for winding and to assure that they do not slip off the spool as the ribbon is later unwound. Some ribbons must also have eyelets near each end for tripping the reversing mechanisms of their typewriters. Additionally, the ribbon material is manufactured in bulk, coming in continuous lengths which contain occasional splices. While such splices are an ordinary feature of the bulk roles, the splices are not acceptable on the final typewriter ribbon spools. The splices must be detected and the spools having them must be discarded.

These limitations considerably restrict the rate at which an operator can wind spools. Even with power driven winding devices, a skilled operator using conventional machinery can wind only approximately 300–800 spools without eyelets in an 8 hour day. If eyelets are required, they are inserted by hand, slowing the operation even further.

A need thus exists for an automatic ribbon winder which requires less operator participation and which can run proportionally faster. Ideally, such a machine should automatically thread, wind, and cut the ribbon on each spool, insert eyelets where desired, and automatically reject spools containing splices.

SUMMARY OF THE INVENTION

Briefly, the present invention provides an automatic ribbon winding machine for winding a length of printing ribbon or the like, such as typewriter ribbon, from a bulk ribbon supply onto a typewriter spool. The machine operator simply places the empty spool in position on the machine and starts the machine (such as by a foot switch). The machine then automatically threads the ribbon onto the spool, winds the proper length of ribbon, and cuts the ribbon off. The machine can also optionally and automatically insert eyelets at predetermined locations along the ribbon. These operations are performed at speeds much faster than possible with manual operation, following which the operator simply removes the newly wound spool of ribbon, places a new empty spool on the machine, and repeats the cycle.

When the cycle is started, the ribbon has already been impaled on a set of pins, such as fine needles, which are mounted in the top of a horizontally movable boat. The fresh, empty spool is placed on the winding arbor and the winding machine is started. A magnet assists in holding the spool on the winding arbor, and when the winding cycle is started, the magnetic field is increased to hold the spool securely thereon.

The boat is then automatically moved in a direction toward the spool on linear bearings which slide on hardened rods. The pins, which are angled so that their points project partially toward the same direction, then draw the leading edge of the ribbon to and slightly beyond the center line of the axis of the hub of the empty spool on the arbor. In drawing the ribbon to the vicinity of the spool, the ribbon is moved along a path past a lifting arm which is mounted on a pick-up lever beneath the path of the ribbon. The pick-up lever is then raised so that the lifting arm engages and deflects the ribbon upwardly and against the spool hub. The spool is of a conventional configuration having a gripper such as one or more darts on its hub for gripping the ribbon. The ribbon has previously had a hole punched therein near its leading edge, and this hole is now pressed against the spool hub by the raised lifting arm. The winding apparatus rotates the arbor and spool slowly so that a dart now enters the hole in the ribbon, engages the ribbon, pulls it off the pins, and begins to wind the ribbon onto the spool.

The path of the ribbon from the bulk supply to the spool carries it around a counter drive wheel. The counter drive wheel is driven by and moves in unison with the ribbon to provide an accurate indication of the actual amount of ribbon which is being advanced onto the spool. The initial ribbon advance is at a slow speed (for example, a spool speed of about 100 rpm) to assure that the ribbon is started properly. As the ribbon is initially advanced, the counter drive wheel is connected to a slow speed counter which registers ½ inch increments of tape advancement. When the counter reaches a pre-set count, this tells the machine that the tape is hooked to the spool. This also returns the boat to the cutoff position. If an eyelet is required, the machine stops and inserts an eyelet. If not, then when the boat is returned, the speed is picked up to a high speed and the count is shifted from the slow speed to a high speed counter (which measures 6 inches increments of tape advancement). The high speed (for example, a spool speed of 2500 rpm) winds the tape quickly onto the spool. During this time the pick-up level and lifting arm stay up to guide the ribbon uniformly onto the spool. When the spool is nearly full, the high speed counter reaches its first undetermined count and the spool drive returns to slow speed. The high speed counter continues counting to a second predetermined count and then either stops the spool to insert an eyelet or shifts directly to the slow speed counter.

The tape then advances at slow speed, the slow speed counter counts to a second count, the spool is then stopped, and a clamp is moved toward the ribbon from the side thereof opposite the boat. The part of the boat adjacent the ribbon serves as an anvil, and the clamp clamps the ribbon against the anvil. A punch punches a hole in the ribbon, a cutoff knife severs the ribbon, and the clamp impales the ribbon onto the pins near its newly cut leading edge. The hole is spaced the proper distance from the end of the ribbon to be engaged by a dart on the next spool. The pick-up lever then returns to its lowered position away from the tape path, terminating the winding cycle. The operator may now remove the loaded spool and replace it with a fresh, empty spool. The operator then restarts the machine, and the winding cycle is repeated.

If the ribbon is to have an eyelet, the spool drive is momentarily terminated just before the beginning and just after the end of the high speed phase. An eyelet machine, or eyeleter, is positioned along the ribbon path and is actuated each time to place an eyelet in the ribbon. Thus, by adjusting the length of tape which is advanced during each of the slow speed winding phases of the spool, the eyelet can be located at the proper distance from the ends of the ribbon.

The counter drive wheel rotates a segmented counter disc which is connected thereto by a common shaft. The segments of the counter disc intercept a pair of light beams for photocell detectors which are connected to electronic counters. In the preferred embodiment the circumference of the counter wheel is six inches, so that the counter wheel rotates once for each 6 inches of ribbon feed. The counter or tabulating disc has apertures or light transmitting segments to indicate various amounts or increments of ribbon length as it passes around the counter wheel. Thus, 12 equally spaced apertures positioned around the disc opposite one of the photocells will cause the increments detected by that photocell to be ½ inch increments. One aperture on the disc opposite the other photocell will cause that photocell and its counter to detect six inch increments. These are the increments used in the preferred embodiment. The ½ inch increments are used for measuring and controlling the slow speed ribbon feed, and the 6 inch increments are for measuring and controlling the high speed feed.

A splice in the ribbon is detected by a splice detector wheel which is mounted adjacent the counter drive wheel. The wheels are mounted for rotation on parallel horizontal axes, and are spaced to define a gap which is greater than the thickness of the ribbon and less than twice the thickness of the ribbon. In the preferred embodiment, the gap is approximately 0.006 inches, so that it will function properly for both 0.003 inch and 0.005 inch standard ribbons. That is, since the ribbon is wrapped tightly about the counter drive wheel, it does not ordinarily contact the splice detector wheel. However, the splices are thicker, and when one passes through the gap, it engages and rotates the splice detector wheel.

The splice detector wheel is weighted near one edge so that, when free, it turns to and remains in a predetermined rest position. A flag rotates with the splice detector wheel, being attached to it by means of its support shaft. When the wheel is in the rest position, the flag is positioned to intercept the light path of a splice detector photocell assembly. When a splice moves through the gap it engages and rotates the splice detector wheel, displacing the flag and allowing the light beam to strike the photocell. This generates a signal which indicates the presence of a splice. The splice indicating signal terminates winding of the ribbon onto the spool so that the spool and splice can be discarded and a new spool started.

It is therefore an object of the present invention to provide an automatic ribbon winding machine which automatically hooks a length of printing ribbon or the like onto an empty spool and then loads the spool with a predetermined length of the ribbon without further intervention or assistance by the machine operator; which will optionally insert eyelets near the leading and trailing ends of the lengths of printing ribbon without assistance or intervention by the machine operator; which will detect splices in the ribbon and, upon detection, immediately terminate winding of the ribbon onto the spool so that the machine operator can discard the spool and replace it with an empty spool; which can load spools more quickly and more accurately than prior art devices and with less operator intervention; which punches a hole in the ribbon near its leading edge, grips the ribbon between the hole and the leading edge, advances that portion of the ribbon to a position adjacent the hub of an empty spool placed by the machine operator on a winding arbor in the machine, wraps the portion of the ribbon having the hole therein about the hub of the empty spool, rotates the spool so that the hook on its hub engages the hole in the ribbon, releases the ribbon from the gripping means, winds the length of ribbon onto the spool, and then severs the ribbon from the ribbon supply; and to accomplish the above objects and purposes in an inexpensive, uncomplicated, durable and reliable machine adapted for winding a wide variety of ribbons onto many different types of spools.

Other objects and advantages of the invention will be apparent from the following description, the accompanying drawings and the appended claims.

DESCRIPTION OF THE PREFERRED EMBODIMENT

Figure 1:
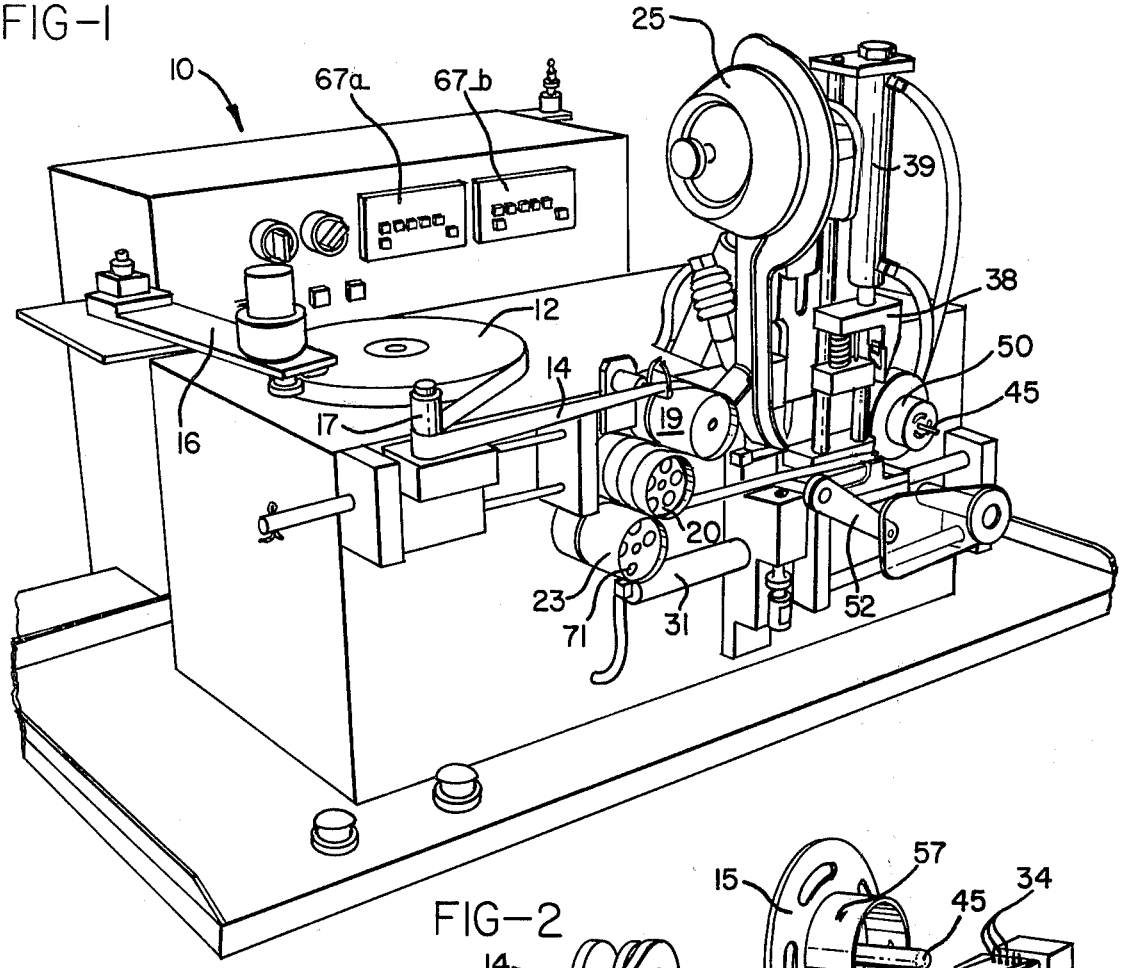
FIG. 1 is a perspective view of the automatic ribbon winding machine.
Figure 2:
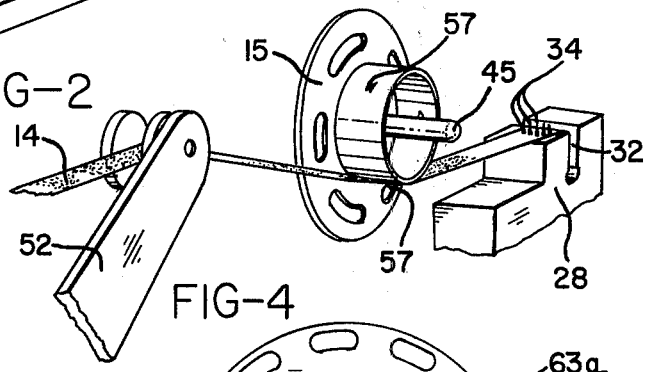
FIG. 2 is an expanded, partially sectioned perspective illustration in which the relative spacings of the boat, spool, and lifting arm have been exaggerated to illustrate the engagement of the spool hook into the ribbon hole.
Figure 5:
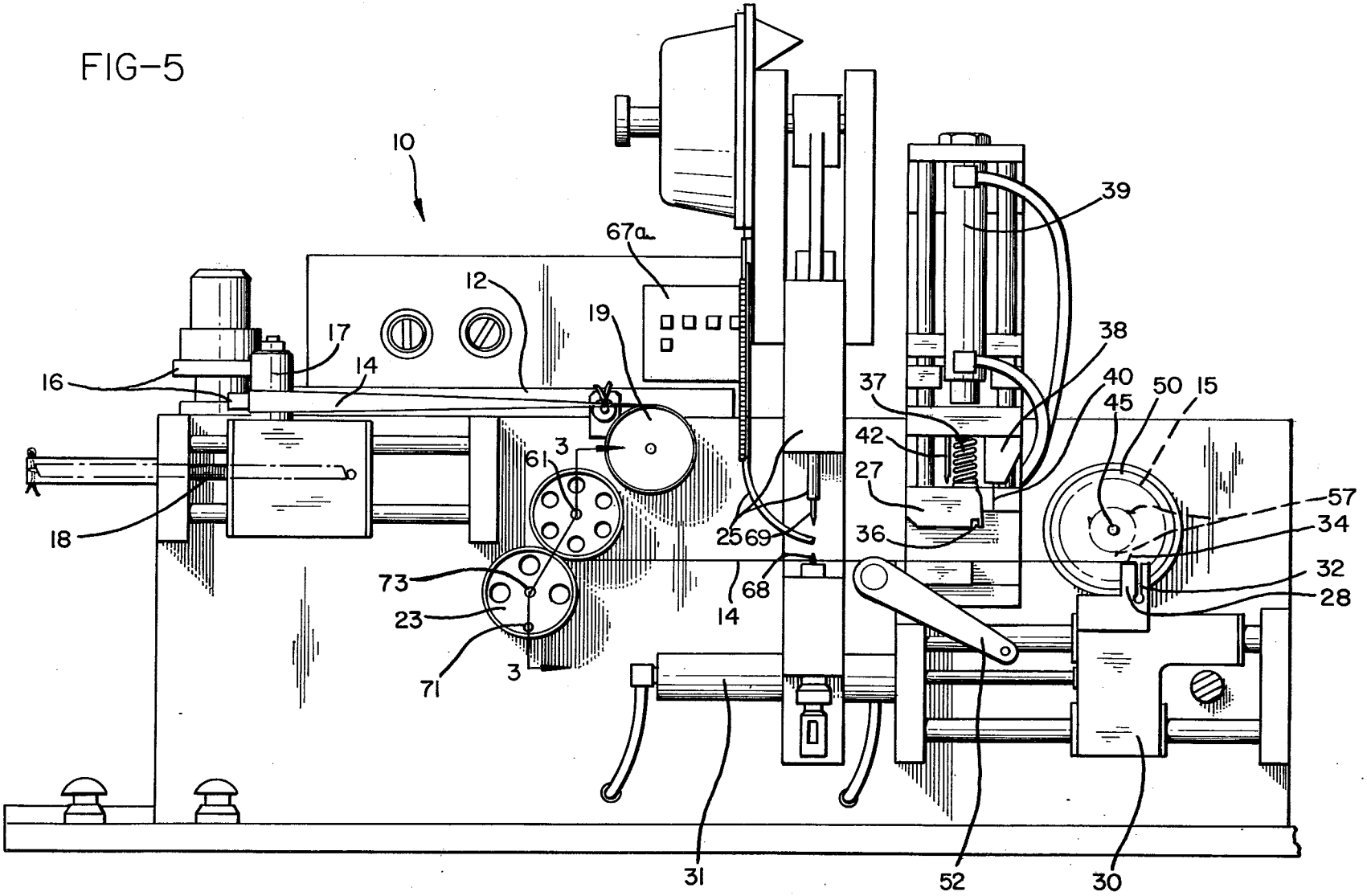
FIG. 5 is an elevational view, partly sectioned, of the front of the automatic ribbon winding machine, with the boat moved to its position adjacent the hub of the empty spool on the winding arbor, and prior to raising the lifting arm and pick-up lever.

The automatic ribbon winding machine 10 illustrated in FIG. 1 supports a bulk supply 12 of printing ribbon 14 or the like from which individual predetermined lengths are cut and wound onto spools such as the spool 15 shown (partially sectioned) in FIG. 2. As the ribbon 14 is unwound from the bulk supply 12, it is retarded by a tension arm 16 to maintain a predetermined tension as the ribbon passes through the machine. The ribbon then winds around a spring-loaded take-up tension roller 17 which is pulled to the right by the ribbon tension and to the left by its spring 18 (FIG. 5). Roller 17 maintains proper ribbon tension during abrupt changes in the rate of ribbon feed. The ribbon then passes around a guide wheel 19 and around a counter drive wheel 20, both of which are mounted on machine 10 for rotation on substantially horizontal axes. The tension on the ribbon holds it against the surface of wheel 20, causing the ribbon 14 to drive the counter wheel so that they move together as the ribbon 14 is advanced through the ribbon winding machine 10. The amount of rotation of the counter drive wheel 20 is thus in direct proportion to the amount of ribbon 14 which is advanced through the machine.

Figure 3:
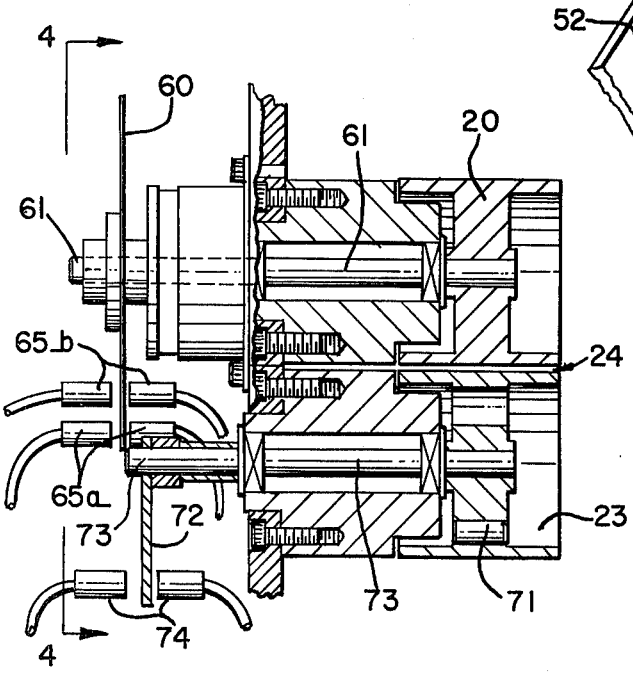
FIG. 3 is a cross sectional view taken generally on line 3—3 of FIG. 5 with the ribbon omitted to show the gap between the counter and splice detector wheels.

A splice detector wheel 23 is mounted adjacent the counter drive wheel 20 with its axis of rotation parallel thereto. Wheels 20 and 23 are spaced from each other to define a gap 24 (FIG. 3) which is greater than the thickness of the ribbon 14 and less than twice the thickness. Thus, as unspliced ribbon passes through the gap 24, it contacts only the counter drive wheel 20, and splice detector wheel 23 remains motionless. However, when a splice passes through the gap 24, the thickness of the splice causes the splice detector wheel 23 to be engaged and rotated by the ribbon and splice. This generates a splice indicating signal which terminates operation of the automatic ribbon winding machine so that the spool 15 having the splice therein can be discarded and replaced with a fresh, empty spool.

Figure 6:
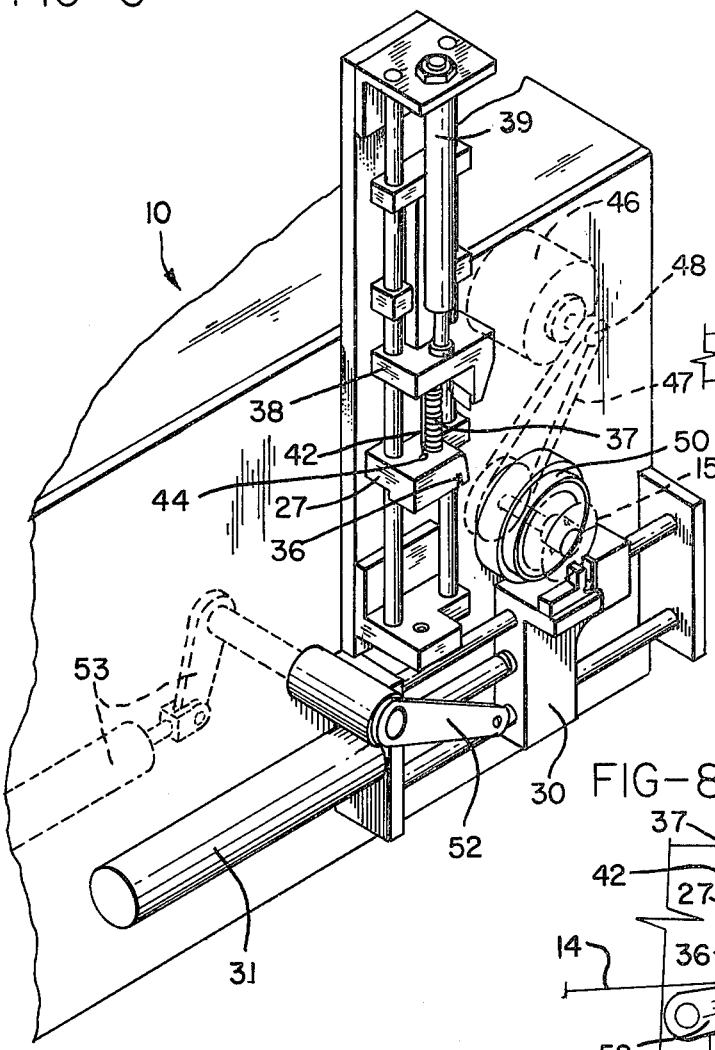
FIG. 6 is an isometric view of the right hand portion of the machine showing the elements in the same position as in FIG. 5 but with the ribbon and eyelet machine omitted for clarity of illustration.
Figure 10:
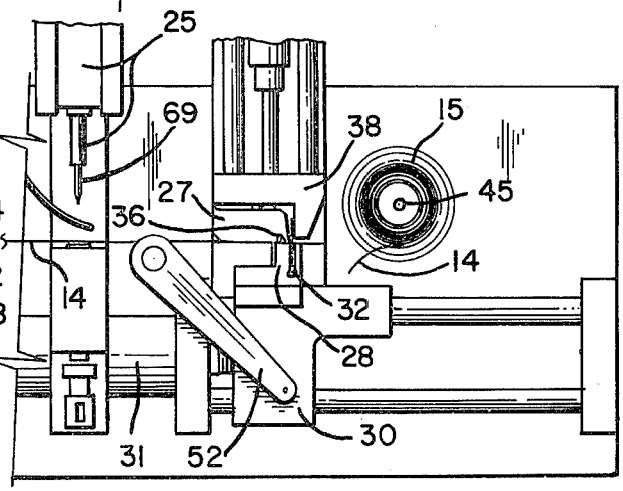
FIG. 10 illustrates severing the ribbon and punching a new hole therein after the proper length of ribbon has been wound onto the spool, and after the lifting arm, pick-up lever, and boat have returned to their start positions.

After the ribbon 14 leaves the counter drive wheel 20 it passes an eyelet machine 25, then goes underneath a clamp 27 and over an anvil 28. The anvil is carried on a boat 30 which is moved by a pneumatic cylinder 31 from an initial or starting position underneath clamp 27 (FIGS. 1 and 10) to a winding position adjacent the hub of an empty spool 15 when the spool is mounted in position on the automatic ribbon winding machine 10 (FIGS. 5 and 6). Anvil 28 includes a cutoff slot 32 and a series of sharp pins 34 which extend vertically and to the right (as shown in FIG. 5) through the top of the anvil 28. The pins are angled so that they project at least partially toward the direction in which the ribbon is advanced as it is wound onto the spool 15. With reference to FIG. 10, the clamp 27 includes a pin recess 36 which provides clearance for the pins and receives them when the clamp is lowered onto the anvil 28. When clamped against the anvil, the clamp impales the ribbon 14 onto the pins 34 (FIG. 10) so that the pins will apply tension to the ribbon and move it to the vicinity of the spool 15 when the boat 30 is moved to the right, that is, in the ribbon advancing direction. The pins 34 are thus a means for gripping the ribbon and advancing it to the spool.

Clamp 27 is lowered by a spring 37 which is moved downwardly by a knife holder 38, and this is reciprocated upwardly and downwardly by a pneumatic cylinder 39. Thus, when the pneumatic cylinder 39 drives the knife holder 38 downwardly, holder 38 compresses the clamp spring 37 to press the clamp 27 against the anvil 28 and clamp the ribbon 14 therebetween, under the pressure of the clamp spring 37. Continued downward movement of the knife holder 38 carries a knife 40 thereon to the anvil 28, drives the knife into the cutoff slot 32, and severs the ribbon. Simultaneously, a hole punch 42, also carried on the knife holder 38, presses through an opening 44 thereof (FIG. 6) in the clamp 27 and through the ribbon 14 to punch a hole 43 (FIG. 7) in the ribbon. Actuation of pneumatic cylinder 39, therefore, simultaneously cuts the ribbon to create a new leading edge thereon, provides a hole 43 in the ribbon at a predetermined location in spaced relation to this leading edge, and impales the ribbon on the pins 34 at a location between the hole and the leading edge of the ribbon.

At this point (FIG. 10) the spool 15 has been fully loaded with a predetermined length of printing ribbon 14 (unless a splice has been detected by the splice detector wheel 23). The fully loaded spool is then removed from the machine 10, an empty spool is loaded thereon, and the winding cycle is repeated.

If a splice is detected while the ribbon is being wound, the splice is advanced to the spool, winding is immediately stopped, and pneumatic cylinder 39 is actuated. This terminates the winding of this spool so that the imperfect ribbon having the splice therein can be discarded and a fresh roll started.

The spools are loaded on a winding arbor 45 located adjacent the extended position (i.e., moved to the right, as illustrated in FIG. 5) of the boat 30. The winding arbor 45, which supports and rotates one of the spools 15 thereon, is rotated by a drive motor 46 connected thereto by a drive belt 47 and pulleys 48 and 49. The arbor is backed by an electromagnetic holder 50 which creates a weak magnetic field when the arbor 45 and spool 15 are stationary. The field is strong enough to hole the spool in position on the arbor, but allows the operator to remove and replace the spool easily. When the arbor 45 is rotated for winding the ribbon, the strength of the magnetic field in holder 50 is increased to secure the spool 15 thereon.

Figure 7:
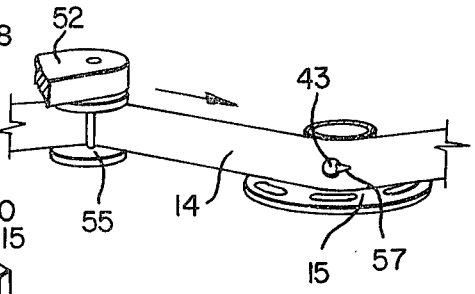
FIG. 7 is a bottom fragmentary view looking upwardly at the ribbon, spool, and lifting arm as shown in FIG. 2.
Figure 8:
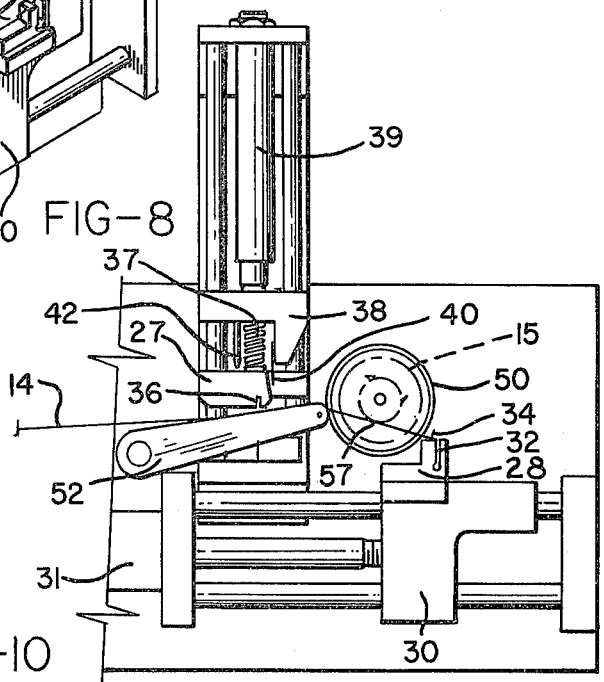
FIG. 8 illustrates the machine in the same position as shown in FIGS. 2 and 7, at the time the spool hooking means engages the hole in the ribbon after the lifting arm and pick-up lever have been raised to deflect the ribbon to a position partially wrapped about the hub of the spool.

Referring to FIG. 10, the leading edge of the ribbon has been gripped by the pins or pin elements 34 on the boat 30. The pneumatic cylinder 39 is then retracted upwardly and the loaded spool is removed (FIG. 1), ending the winding cycle. An empty spool is then placed on the winding arbor 45 and the next winding cycle is started. This causes the boat to advance to the vicinity of the winding arbor 45 (FIGS. 5 and 6). A pick-up lever 52 is then raised (FIGS. 2, 7 and 8) by a pneumatic cylinder and crank assembly 53 (FIG. 6) to move a lifting arm 55 (FIG. 7) into the space between the hole punch 42 and the winding arbor 45 (FIG. 8). This causes the lifting arm 55 to engage the ribbon 14 and raise it, as shown in FIGS. 2, 7 and 8, so that the ribbon is moved toward the hub of the spool 15 and wrapped partially therearound. The spacing of the boat 30 and the hole 43 in the ribbon 14 is such that, with the pick-up lever 52 and lifting arm 55 thus raised, hole 43 is held against the hub of the spool 15 (FIG. 7).

Spools such as spool 15 are commonly provided with a dart or similar hooking means 57, which, when the drive is actuated to rotate the spool in a counterclockwise direction, will engage hole 43 in the ribbon, as shown in FIG. 7, to secure the ribbon onto the hub of the spool 15. Continued rotation of the arbor 45 then causes the spool to begin winding the ribbon 14 thereon. This causes the ribbon to continue advancing in the same direction in which it was originally advanced by the boat 30, when the boat was moved toward the right by the pneumatic cylinder 31. This moves the ribbon faster than the boat in that direction, lifting and slipping the ribbon off the pins and releasing it from the grip thereof. In the preferred embodiment the pins 34 are tilted at about 5°-10° from the vertical. The angle, which is in the direction of ribbon advancement, should be sufficient to prevent premature release while the spool hooks are engaging the ribbon.

Figure 4:
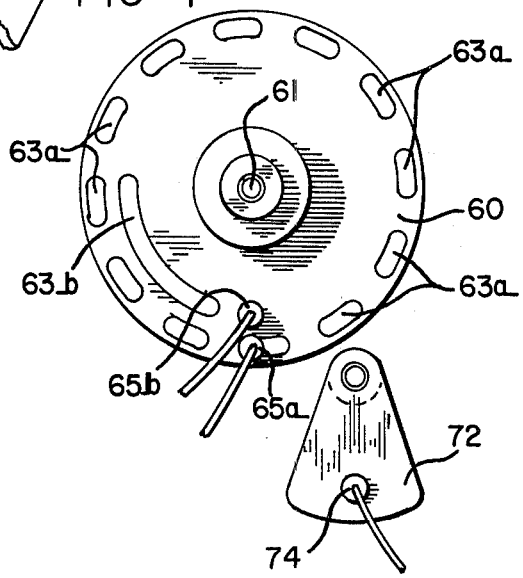
FIG. 4 is a view taken on view line 4—4 of FIG. 3, with portions omitted for clarity of illustration.

The automatic ribbon winding machine 10 of the present invention winds and measures a predetermined length of ribbon 14 onto the spool 15 without regard to the number of revolutions of the spool. Thus, when the ribbon is first being hooked, the spool 15 can continue to rotate until the hooking means 57 engages the ribbon 14 and these revolutions will have no effect on the amount of ribbon which is ultimately wound onto the spool. Once the ribbon 14 has started to advance, it begins rotating the counter drive wheel 20. This causes a tabulating disc 60 (FIGS. 3 and 4), which is supported on the shaft 61 of the counter drive wheel 20, to rotate synchronously therewith. Tabulating disc 60 has holes therein 63*a* and 63*b* which serve as light transmitting segments. In the preferred embodiment, twelve light transmitting segments 63*a* are located at equally spaced intervals around the outside of the tabulating disc 60, and a single light transmitting segment 63*b* is located at a radially inwardly spaced location on the disc (FIG. 4).

Outer and inner photocell assemblies 65*a* and 65*b* are located in stationary positions on each side of the paths, respectively, of the light transmitting segments 63*a* and 63*b* as the disc 60 is rotated. Thus, as the tabulating disc 60 makes one complete revolution, the light beam of the outer photocell assembly 65*a* will be interrupted 12 times, and that of the inner photocell assembly 65*b* one time. The output of the outer photocell assembly 65*a* is connected to a counter 67*a*, and the output of the inner photocell assembly 65*b* to a counter 67*b*. In the preferred embodiment, the circumference of the counter drive wheel 20 is 6 inches, so that one revolution of the counter drive wheel will move twelve segments 63*a* past photocell assembly 65*a* and one segment 63*b* past assembly 65*b*, registering either twelve ½ inch increments of ribbon advancement on counter 67*a* or one 6 inch increment on counter 67*b*.

Thus, when the spool hooking means 57 engages the ribbon as the spool is rotated at slow speed, the ribbon begins to advance, rotating the counter drive wheel 20. At this time, the slow speed counter 67*a* tallies the length of ribbon which is being wound onto the spool hub, by responding to the pulses from the outer photocell assembly 65*a*. (The inner photocell assembly 65*b* is preferably deactivated at this time.) Counter 67*a* is preset to continue the slow speed winding until enough ribbon has been advanced to wrap around the spool hub several times. At this point, control of the winding is transferred to the high speed counter 67*b* (preferably by deactivating photocell assembly 65*a* and activating assembly 65*b*).

Figure 9:
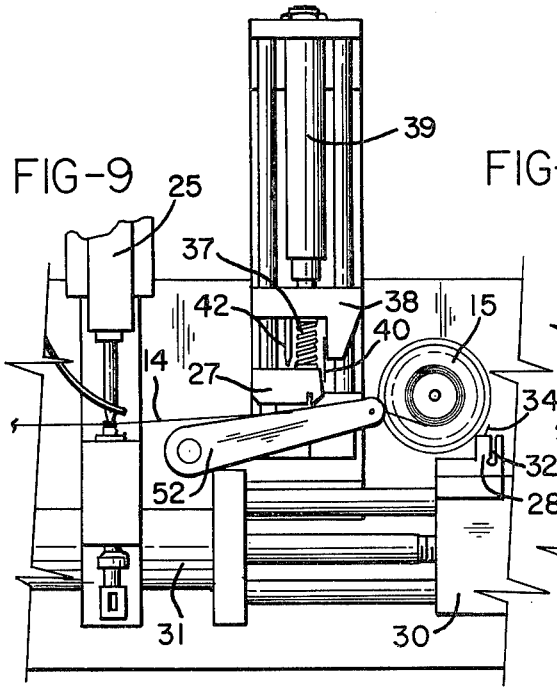
FIG. 9 illustrates insertion of an eyelet into the ribbon.

If an eyelet is to be inserted, the initial length of ribbon wound at slow speed under control of counter 67*a* is selected to be the length desired between the leading edge of the ribbon and the eyelet. When the slow speed counter 67*a* reaches this first, predetermined count, the ribbon is momentarily stopped and the eyeleter 25 is actuated (FIG. 9). In the preferred embodiment, the eyeleter 25 uses the feeder from a Simpson automatic feed eyeleting machine, model 489. The balance of the eyeleting machine has been modified, however, to punch a hole in the ribbon before the eyelet is inserted. This provides a better eyelet, especially when nylon ribbon is being wound. (Nylon is so strong that it may distort the eyelet if a hole is not pre-punched). Therefore the lower pin 68 (FIG. 5) on the eyeleting machine is raised, then the spindle 69 is reciprocated down (without an eyelet) over the pin 68 to press the ribbon down around the pin, pre-punching a hole in the ribbon. Spindle 69 is then raised and reciprocated down once again, this time in conventional manner, first receiving an eyelet and then inserting it into the hole in the ribbon (FIG. 9). Control is then transferred to counter 67*b*, and the ribbon is advanced and wound at high speed.

The counters 67*a* and 67*b* may each be pre-set for two successive counts, providing a first output when the first count is reached and a second output when the second count is reached, following which the counters are reset to zero. A suitable counter for this purpose is the Veeder Root #7993.

Thus, after counter 67*a* reaches its first count, control is transferred to the high speed counter 67*b*. If an eyelet is to be inserted, the ribbon is stopped and the eyelet inserted. Otherwise the speed of arbor drive motor 46 is shifted directly from low to high without stopping the spool to wind the largest length of ribbon onto the spool 15. During high speed operation the inner photocell assembly 65*b* transmits pulses to the high speed counter 67*b*, each pulse representing a 6 inch increment of ribbon advancement.

When counter 67*b* reaches a first predetermined count representing a nearly full spool, it retains control, but shift motor 46 back to slow speed to allow the automatic ribbon winding machine 10 time to slow down. Shortly thereafter, counter 67*b* reaches its second count, at which time it returns control of ribbon advancement to the slow speed counter 67*a*. At this point an eyelet may again be inserted by stopping the spool and cycling the riveter 25 as before. Then the counter 67*a* advances the ribbon 14 at slow speed until counter 67*a* reaches its second predetermined count indicating a full reel. At this time the spool is stopped, pneumatic cylinder 39 is actuated to sever the ribbon, impale the leading end of the next length of ribbon onto the pins 34, and punch the next hole 43 in the ribbon for the spool hub hook 57 of the next spool. The magnetic field in the magnetic holder 50 is then reduced, and the machine operator removes the spool and replaces it with an empty one. The operation is then repeated.

As will be apparent, the operation of machine 10 can easily be automated by suitable and conventional control circuitry, including counters 67*a* and 67*b* which are pre-set for the lengths of ribbon desired. Switches may also be provided to control whether or not the riveter 25 will be operated at the appropriate times to insert rivets in the ribbon. Preferably motor 46 is left running (at slow or high speed) at all times for better service life, and winding arbor 45 is started and stopped by a convention clutch/brake connected to motor 46.

If a splice is encountered at any point during the winding operation, the splice will fill the gap 24 between the counter drive wheel 20 and the splice detector wheel 23, causing the splice detector wheel to rotate. Such movement of wheel 23 will be detected and immediately stop the operation of machine 10. It will also operate pneumatic cylinder 39 to prepare the ribbon for a new spool and to allow the machine operator to discard the spool having the splice therein. The splice detector can also be connected to reset counters 67*a* and 67*b* to zero.

Splice detector wheel 23 has a weight 71 (FIG. 5) which is located outside its axis of rotation. For example, wheel 23 may be made of aluminum and weight 71 may be a plug of iron. This causes wheel 23 to return under the force of gravity to a predetermined rest position, as illustrated in FIG. 5, when free of contact with the ribbon 14. When in this position, wheel 23 holds a flag 72 (FIGS. 3 and 4), which is supported for rotation with wheel 23 on its shaft 73, in the light path of a splice detector photocell assembly 74. Photocell assembly 74 is part of the splice detecting circuitry and provides an output signal to indicate the presence of a splice in the ribbon 14 when wheel 23 and flag 72 are rotated. As indicated, this then terminates winding and prepares the machine 10 for receiving a fresh, empty spool.

As may be seen, therefore, the present invention provides numerous advantages. It eliminates the need for the operator to cut the ribbon manually and to thread the ribbon manually onto the empty spools. It provides an automatic and accurate count of the length of ribbon loaded onto the spool, for more uniform and consistent production. It automatically detects splices in the ribbon so that defective spools may be discarded. The eyeleting machine may be used to place eyelets in the ribbon, as desired, without requiring the operator to handle the ribbon or the eyelets. The machine may be operated in an automatic mode so that the operator is required only to place an empty spool on the machine, start it, and then later remove the loaded spool from the machine. With the present invention, it has been possible for an operator to wind as many as 2,000 spools of typewriter ribbon in an eight hour day if the ribbon does not have eyelets, and as many as 1,200 spools of ribbon having eyelets. Thus, the amount of manual labor involved in preparing and winding spools of typewriter ribbon has been substantially reduced, and the output of the operator substantially increased.

While the form of apparatus herein described constitutes a preferred embodiment of this invention, it is to be understood that the invention is not limited to this precise form of apparatus, and that changes may be made therein without departing from the scope of the invention.

What is claimed is:

1. An automatic ribbon winding machine for winding a length of printing ribbon or the like from a supply thereof onto a spool having a hub and hooking means formed in the hub for securing the ribbon on the hub through a hole in the ribbon near the leading edge of the length of ribbon, comprising:

a. means for supporting such a spool on the machine and for rotating the spool in a winding direction, b. means for punching a hole in the ribbon at a predetermined location in spaced relation to the leading edge thereof, c. pin means for gripping the ribbon at a location near the leading edge of the ribbon by penetration of the ribbon from one side thereof for applying tension to and moving the ribbon with said gripping means when said gripping means is moved in a first, ribbon advancing direction and for releasing the ribbon therefrom when the ribbon is moved faster relative thereto in the same direction, d. means for moving said gripping means in said first direction to bring the leading edge of the ribbon and the portion thereof having said hole therein to positions adjacent the hub of an empty spool on said spool supporting and rotating means, and e. means causing the portion of the ribbon having said hole therein to be partially wrapped about the hub of an empty spool supported on said spool supporting and rotating means while the hub is rotated so that rotation of the spool provides for engagement of the spool hooking means with said hole for pulling the ribbon in said first direction, releasing the ribbon from said gripping means, and winding the length of ribbon from the supply thereof onto the spool.

2. The machine of claim 1 further comprising:

a. means engageable with the ribbon in the path thereof between the ribbon supply and the spool when supported on said machine for severing the ribbon from a fully wound spool, and b. gripper means operable by said ribbon severing means for causing engagement with said gripping means of the end of the ribbon coming from the supply thereof.

3. The machine of claim 1 in which said gripping pin means comprises a plurality of pin elements and means supporting said pin elements with the points thereof projecting at least partially toward said first direction.

4. The apparatus of claim 3 further comprising:

a. an anvil on one side of the ribbon and including said means supporting said pin elements, b. a clamp on the other side of the ribbon opposite said anvil, c. means for moving said clamp toward said anvil to clamp the ribbon therebetween and to press the ribbon onto said pin elements, d. said hole punching means operated by said clamp moving means to punch said hole in said ribbon as said ribbon is clamped therebetween, and e. cutoff means also operated by said clamp moving means to sever said ribbon as said ribbon is clamped, for ending one spool of ribbon and for preparing the leading edge of the ribbon for the next spool.

5. The apparatus of claim 1 further comprising a boat means for moving said ribbon gripping means in said first direction from said hole punching means to said spool supporting and rotating means, a lifting arm and pick-up lever and operating mechanism therefor for moving said pick-up lever into the space between said hole puching means and said spool supporting and rotating means after said boat has moved the leading edge of the ribbon to said spool supporting and rotating means and to the spool thereon to cause said lifting arm to engage said ribbon and move it toward the hub of the spool to wrap the ribbon partially therearound for engagement of the spool hooking means with said hole.

6. The apparatus of claim 1 further comprising means for detecting and tabulating the length of ribbon which is being advanced independently of the number of revolutions of the spool.

7. The apparatus of claim 6 wherein said detecting and tabulating means further comprises a first wheel around which said ribbon passes, said ribbon winding machine holding the ribbon in contact with the surface of said wheel to rotate said wheel as the ribbon advances, and means for detecting rotation of said wheel and tabulating the increments of rotation thereof.

8. The apparatus of claim 7 wherein said means for tabulating the increments of rotation of said wheel includes:

a. a disc having light transmitting segments thereon and being attached to said wheel for rotation therewith, b. a counter, and c. photocell means mounted adjacent said disc for detecting passage of said segments thereby as said disc rotates and for transmitting signals to said counter for tallying the number thereof, said increments being directly related to the length of ribbon passing through said ribbon winding machine on said wheel as said wheel rotates therewith.

9. An automatic ribbon winding machine for winding printing ribbon or the like from a supply thereof onto an empty spool having a hub and means on the hub for securing the ribbon thereto, comprising:

a. means for supporting such a spool on the machine and for rotating the spool in a winding direction, and b. means including pin means for impaling the ribbon adjacent the leading edge thereof for moving the ribbon in a ribbon advancing direction to bring the ribbon into partial wrapping relation to the spool hub for engagement with the hub securing means while the hub is rotated and automatically releasing the ribbon from said pin means when the ribbon is gripped by the hub securing means in response to the rotation thereof.

10. An automatic ribbon winding machine for winding a length of printing ribbon or the like from a supply thereof onto a spool having a hub and hooking means formed in the hub for securing the ribbon on the hub through a hole in the ribbon near the leading edge of the length of ribbon, comprising:

a. a winding arbor adapted to support a ribbon spool thereon and to rotate the spool in response to rotation of said winding arbor, b. means for rotating said winding arbor, c. an eyeleter located on the path of the ribbon between the supply thereof and the spool on said winding arbor for attaching eyelets to the ribbon, said eyeleter including means for pre-punching eyelet receiving holes in the ribbon for receiving the eyelets therein, d. means in the path of the ribbon between the supply thereof and the spool on said winding arbor for punching a hole in the ribbon at a predetermined location in spaced relation to the leading edge thereof, e. an anvil on one side of the ribbon in the path thereof between the hole punching means and the spool on said winding arbor, f. a boat supporting said anvil and being supported for movement between said hole punching means and said winding arbor, g. means for moving said boat back and forth between said hole punching means and said winding arbor, h. a plurality of pin elements supported on said anvil with the points thereof projecting at least partially toward said winding arbor, said pins gripping the ribbon at a location between the hole therein and the leading edge thereof for applying tension to the ribbon and moving it by means of said pin elements when said pin elements are moved on said boat in a first, ribbon advancing direction and for releasing the ribbon therefrom when the ribbon is moved faster relative thereto in the same direction, i. a clamp on the other side of the ribbon opposite said anvil when said anvil is adjacent said hole punching means, j. means for moving said clamp toward said anvil to clamp the ribbon therebetween and to press the ribbon onto said pin elements so that the pins grip the ribbon, k. said hole punching means separated by said clamp to punch said hole in said ribbon as said ribbon is clamped therebetween, l. cutoff means also operated by said clamp moving means to sever said ribbon as said ribbon is clamped, for ending one spool of ribbon and for preparing the leading edge of the ribbon for the next spool, m. said boat means, when moved to said winding arbor, bringing the leading edge of the ribbon and the portion thereof having said hole therein to positions adjacent the hub of an empty spool on said arbor, n. a lifting arm and pick-up lever and operating mechanism therefor for moving said pick-up lever into the space between said hole punching means and said winding arbor after said boat has moved the leading edge of the ribbon to said winding arbor and to the empty spool thereon to cause said lifting arm to engage said ribbon and move it toward the hub of the spool to wrap the ribbon partially therearound for engagement of the spool hooking means with said hole while the hub is rotated, so that rotation of the spool provides for engagement of the spool hooking means with said hole for pulling the ribbon in said first direction, releasing the ribbon from said pins, and winding the length of ribbon from the supply thereof onto the spool, o. means for detecting and tabulating the length of ribbon which is being advanced independently of the number of revolutions of the spool, including i. a first wheel around which said ribbon passes, said first wheel being mounted for rotation on a horizontal axis and said holding the ribbon in contact with the surface of said wheel to rotate said wheel as the ribbon advances, ii. a disc having light transmitting segments thereon and being attached to said wheel for rotation therewith, iii. a counter, and iv. photocell means mounted adjacent said disc for detecting passage of said segments thereby as said disc rotates and for transmitting signals to said counter for tallying the number thereof, said increments being directly related to the length of ribbon passing through said ribbon winding machine on said wheel as said wheel rotates therewith, and p. a splice detector to prevent inadvertently winding a spool of ribbon containing a splice therein, including i. a second wheel mounted on said ribbon winding machine with its axis of rotation parallel to that of said first wheel, said wheels being spaced a predetermined distance from one another to define a gap therebetween, ii. said gap being greater than the thickness of the ribbon and less than twice the thickness of the ribbon, iii. means guiding the ribbon through said gap in contact with the surface of said first wheel, iv. said second wheel including a weight located outside its axis of rotation to cause it to return under the force of gravity to a predetermined rest position when free of contact with the ribbon, v. a flag attached to said second wheel for rotation therewith, said flag being located in a predetermined rest position when said second wheel is located in said predetermined rest position, and vi. photocell detector means for detecting when said flag has been displaced from said rest position in response to rotation of said second wheel caused by the presence of a splice and for generating a splice indicating signal to indicate the presence thereof and to terminate winding of the ribbon upon the spool when said photocell detector means generates said splice indicating signal, the ribbon and said first wheel moving together when unspliced ribbon moves through said gap, the unspliced ribbon being free of driving contact with said second wheel and said second wheel therefore remaining stationary, and passage of a ribbon splice through said gap causing said second wheel to be engaged by the ribbon and splice to rotate said second wheel and generate said splice indicating signal.

11. For use in an automatic ribbon winding machine for winding a length of printing ribbon or the like upon a spool from a supply thereof, a splice detector to prevent inadvertently winding a spool of ribbon containing a splice therein, comprising:

a. a first wheel and a second wheel mounted on said ribbon winding machine adjacent one another and with their axes of rotation parallel to one another, said wheels being spaced a predetermined distance from one another to define a gap therebetween, b. said gap being greater than the thickness of the ribbon and less than twice the thickness of the ribbon, c. means guiding the ribbon through said gap in contact with the surface of said first wheel, d. the ribbon and said first wheel moving together when unspliced ribbon moves through said gap, the unspliced ribbon being free of driving contact with said second wheel and said second wheel therefore remaining stationary, and passage of a ribbon splice through said gap causing said second wheel to be engaged by the ribbon and splice to rotate said second wheel, e. means for detecting rotation of said second wheel and for generating a signal to indicate the presence of a splice upon rotation of said second wheel, f. said detecting means including a flag attached to said second wheel for rotation therewith, said flag being located in a predetermined rest position when said second wheel is located in said predetermined rest position, photocell detector means for detecting when said flag has been displaced from said rest position for generating said signal, and g. means connected to said photocell detector means operable to terminate winding of the ribbon upon the spool when said photocell detector means generates said splice indicating signal.

* * * * *

UNITED STATES PATENT AND TRADEMARK OFFICE

CERTIFICATE OF CORRECTION

PATENT NO. : 4,116,398

DATED : September 26, 1978

INVENTOR(S) : Bruce D. Roberts

It is certified that error appears in the above-identified patent and that said Letters Patent are hereby corrected as shown below:

Column 8, line 22, "shift" should be -- shifts --.

Column 11, line 66, Claim 10, "separated" should be -- operated --.

Signed and Sealed this

*Twenty-fifth* Day of *March 1980*

[SEAL]

*Attest:*

SIDNEY A. DIAMOND

*Attesting Officer*

*Commissioner of Patents and Trademarks*